US005630264A

United States Patent [19]

Tsuji

[11] Patent Number: 5,630,264

[45] Date of Patent: May 20, 1997

[54] APPARATUS FOR INSERTING INSERT MEMBERS

[75] Inventor: Makoto Tsuji, Zama, Japan

[73] Assignee: Toshiba Kikai Kabushiki Kaisha, Tokyo-to, Japan

[21] Appl. No.: 394,295

[22] Filed: Feb. 24, 1995

[30] Foreign Application Priority Data

Feb. 25, 1994 [JP] Japan ..... 6-028317

[51] Int. Cl.[6] ..... B23P 19/04

[52] U.S. Cl. ..... 29/234

[58] Field of Search ..... 29/464, 466, 468, 29/700, 281.5, 33 J, 38 R, 38 B, 35.5, 235, 234

[56] References Cited

U.S. PATENT DOCUMENTS 3,073,016 1/1963 Drake ..... 29/235
3,535,764 10/1970 Hoffman ..... 29/234
3,987,532 10/1976 Shemtov ..... 29/234
4,653,182 3/1987 Fukuda et al. ..... 29/235
5,090,115 2/1992 Fuller et al. ..... 29/235

*Primary Examiner*—Robert C. Watson
*Attorney, Agent, or Firm*—Cushman Darby & Cushman, IP Group of Pillsbury Madison & Sutro, LLP

[57] ABSTRACT

An apparatus for inserting one or more insert members comprises the steps of holding sleeve-like insert members onto insert holders, transferring the insert holders between metal molds which are apart, pivotably moving the insert holders so that the axes thereof are aligned with the axes of parts, onto which the insert members are to be fitted, in one of the metal molds, pressing out the insert members from the insert holders and fitting them onto the parts, onto which the insert members are to be fitted. This method allows the number of the insert holders to be reduced to half, thereby achieving a reduction in weight and a saving in space.

12 Claims, 7 Drawing Sheets

APPARATUS FOR INSERTING INSERT MEMBERS

FIELD OF THE INVENTION

The present invention relates to an apparatus for inserting one or more insert members and, more particularly, an apparatus for inserting one or more insert members which are used for a die casting machine for casting a cast article in which the directions of inserting the insert members intersect with each other like a cylinder block of an internal combustion engine, and which enable a reduction in weight and a saving in space.

BACKGROUND OF THE INVENTION

For example, in the case where cylinder blocks of an internal combustion engine and bearing brackets of an electric motor are cast from aluminum using a die casting machine, there has been widely adopted a method of casting the cylinder blocks or the bearing brackets with sleeve-like insert members made of steel being disposed therein so as to form the surfaces of the cylinders on which pistons slide or the surfaces of the bearing brackets on which the bearings are held, in order to enhance mechanical properties such as the strength and wear resistance of the above-mentioned surfaces. In order to cast the cylinder blocks or the bearing brackets with the above-mentioned insert members disposed therein, it is necessary to previously load a movable metal mold with the insert members at predetermined places thereof, the metal molds being in a separated condition.

For this purpose, an apparatus for inserting one or more insert members is proposed to achieve an automation of the loading operation of the insert members, and is known, for example, from JPB-Hei-3-66982.

As shown in FIG. 6, this apparatus for inserting insert members comprises an insert head 61, which is provided with a guide holder 56 for holding an insert member 100 in a detachable and floating way; a air piston-cylinder assembly 60 for moving forward the guide holder 56; and a pusher air piston-cylinder assembly 62 for pushing out the insert member 100 from the guide holder 56 in order to achieve an automation of the loading of the insert members. The insert head 61 is of such a construction that it is transferred to a predetermined position of a movable metal mold by means of a link mechanism and the guide holder is centered by means of a positioning mechanism.

FIG. 7 is a plan view showing an arrangement of the insert head 61 in the case where the mold for casting the cylinder blocks of an internal combustion engine is loaded with the insert members. In order to cast such cylinder blocks with the insert members disposed therein, a pair of insert heads is arranged between a stationary metal mold (not shown) and the movable metal mold 103. In this case, since in the movable metal mold 103 the directions of inserting the insert members intersect with each other in the partial sections 44 and 46 thereof onto which the insert members are to be fitted, the guide holders 56 and 58 are arranged with their positions inclined by angles of C and D so as to correspond to the above-mentioned intersected directions in the movable metal mold 103.

Thus, since casting the cylinder blocks using the die casting machine requires the provision of two pairs of insert holders corresponding to the arrangement of two kinds of cylinders different in the phases of angles, there is a problem of the apparatus becoming large in size and, so, the space occupied by the apparatus correspondingly being increased.

Particularly, since the insert head must be carried into and out of the narrow space between the stationary metal mold and the movable metal mold, there is a disadvantage of the insert head having to be carried making a detour to avoid any interference with the parts of the die casting machine.

SUMMARY OF THE INVENTION

An object of the invention is to solve the problems in the above-mentioned prior art and to provide a method and an apparatus for inserting one or more insert members which allows a reduction in weight and a saving in space to be achieved by reducing the number of the insert holders to half.

In order to achieve the above-mentioned object, according to the present invention, there is provided a method for inserting one or more sleeve-like insert members which comprises the steps of

- holding said sleeve-like insert members on the respective insert holders;
- transferring said insert holders between metal molds which are apart;
- pivotably moving said insert holders so that the axes of said insert holders are aligned with those of parts, onto which said insert members are to be fitted, in one of said metal molds;
- moving said insert holders to a position where they come into an abutting engagement with said parts, onto which said insert members are to be fitted, and
- pressing out said insert members from said insert holders and fitting said insert members onto said parts, onto which said insert members are to be fitted.

In a further aspect of the invention, there is provided an apparatus for inserting one or more insert members which comprises

- an insert head including insert holders for holding sleeve-like insert holders;
- a mechanism for holding said insert holders for transfer movement in the direction of inserting said insert members and for pivotable movement about a shaft intersecting perpendicular to the direction of said transferring movement; and
- a mechanism for pressing out said insert members from said insert holders in the direction of inserting said insert members, and
- a positioning mechanism which supports said insert head for transferring movement in at least the two and more axial directions intersecting perpendicular to each other and which positions said insert head between said metal molds which are apart.

BRIEF DESCRIPTION OF THE DRAWINGS

Other objects and aspects of the invention will become apparent from the following description of an embodiment with reference to the accompanying drawings in which.

PREFERRED EMBODIMENT OF THE INVENTION

One embodiment of an apparatus for inserting insert members according to the present invention will be explained with reference to the accompanying drawings.

Figure 4:
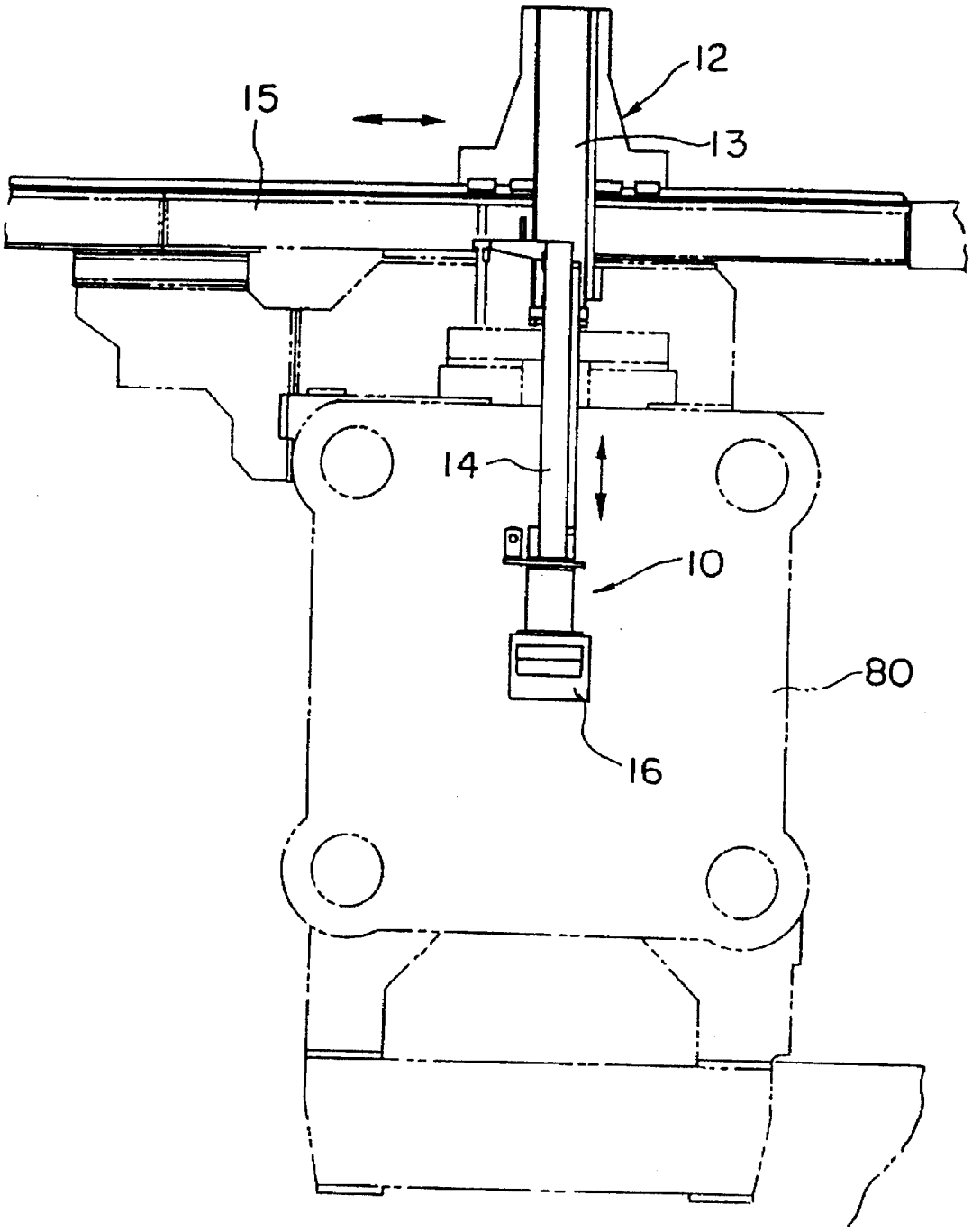
FIG. 4 is an explanatory view showing a relation of arrangement when the apparatus for inserting insert members is transferred into the space between metal molds which are apart.

FIG. 4 is a view showing a relation of the arrangement in an example in which the apparatus for inserting insert members according to the present embodiment is applied to a die casting machine. Reference character 10 generally indicates an apparatus for inserting insert members, and reference character 80 indicates a stationary metal mold of a die casting machine.

The insert member-inserting apparatus 10 is attached to the lower end of a liftable arm 14 which is suspended from a supporting arm 13 of a carrying device 12. This carrying device 12 can move in a reciprocating movement by itself on a rail 15 within the space existing between the metal molds and a supply station for insert members (not shown).

Figure 1:
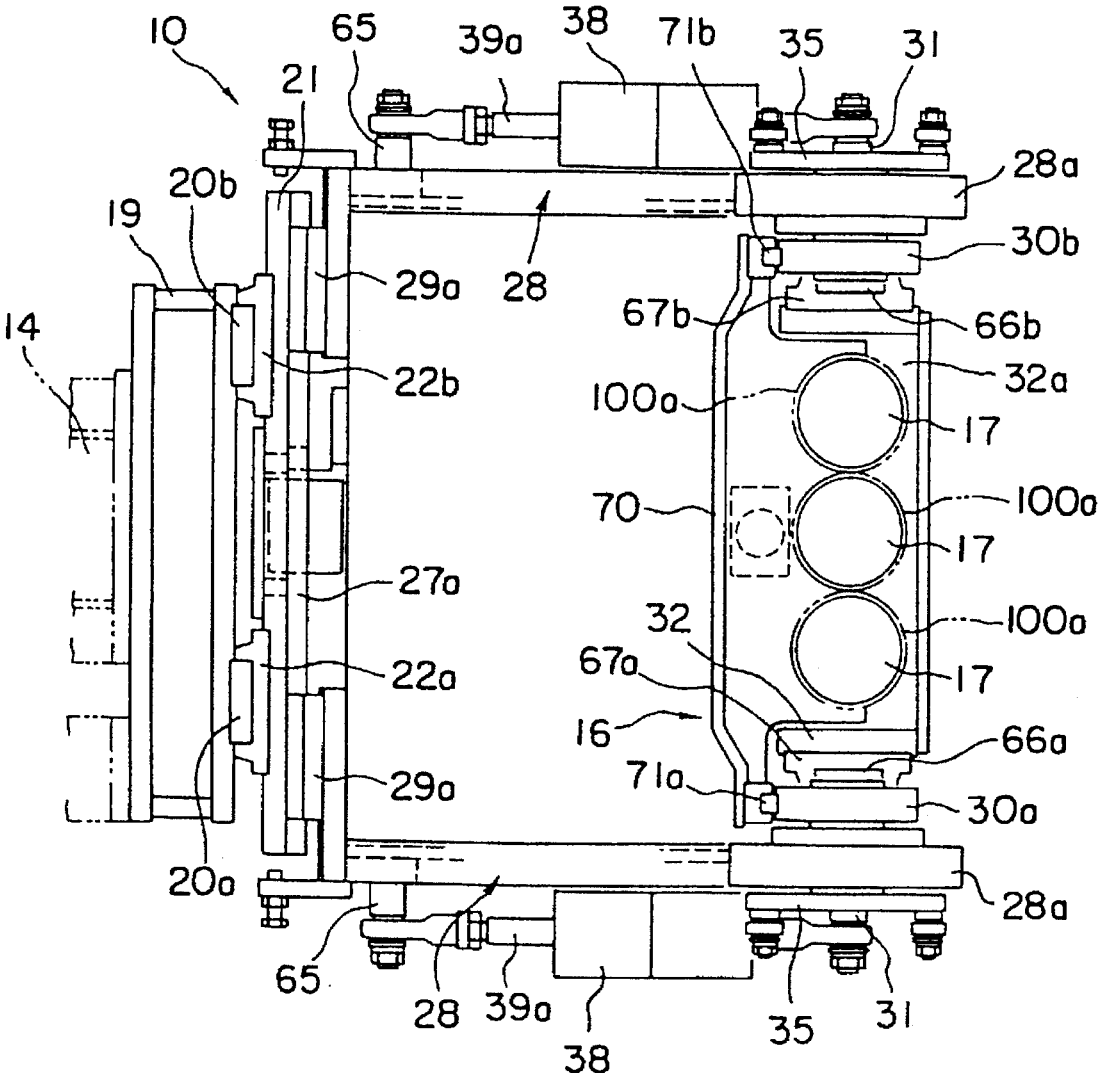
FIG. 1 is a front view showing an embodiment of an apparatus for inserting insert members according to the present invention.
Figure 3:
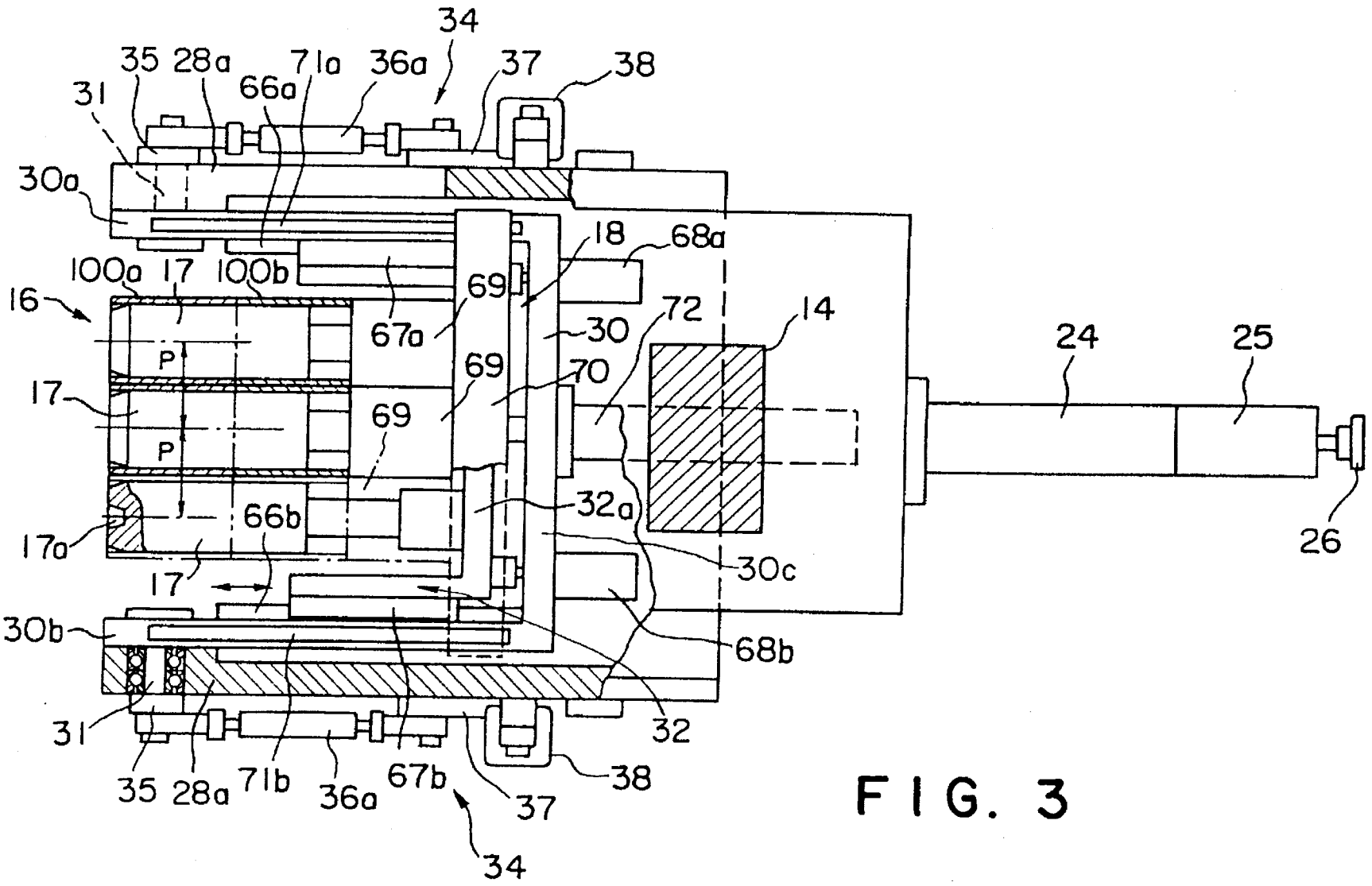
FIG. 3 is a side view of the apparatus shown in FIG. 1 with parts partially broken away.
Figure 5:
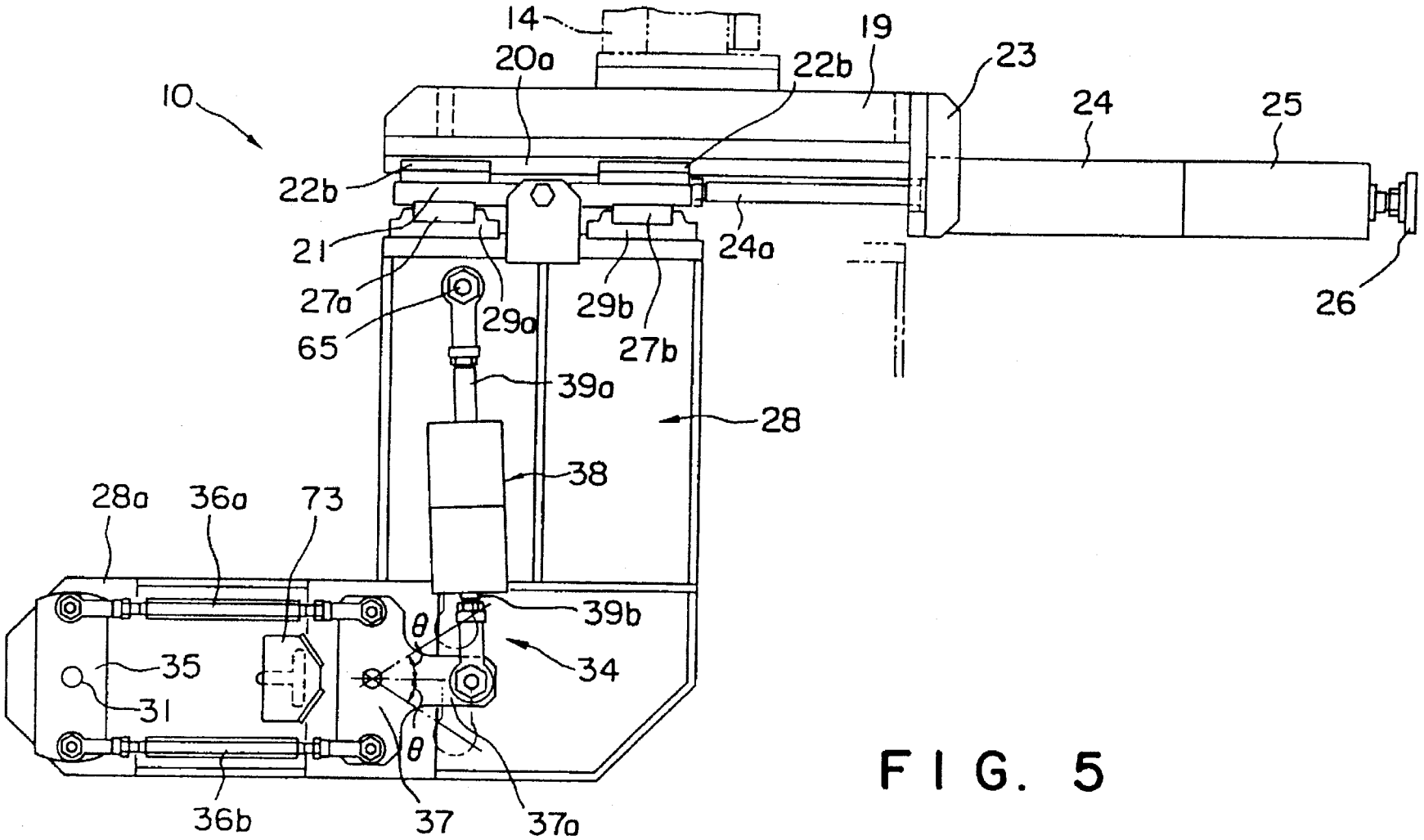
FIG. 5 is a schematic front view showing a function of the apparatus for inserting insert members according to the invention.
Figure 6:
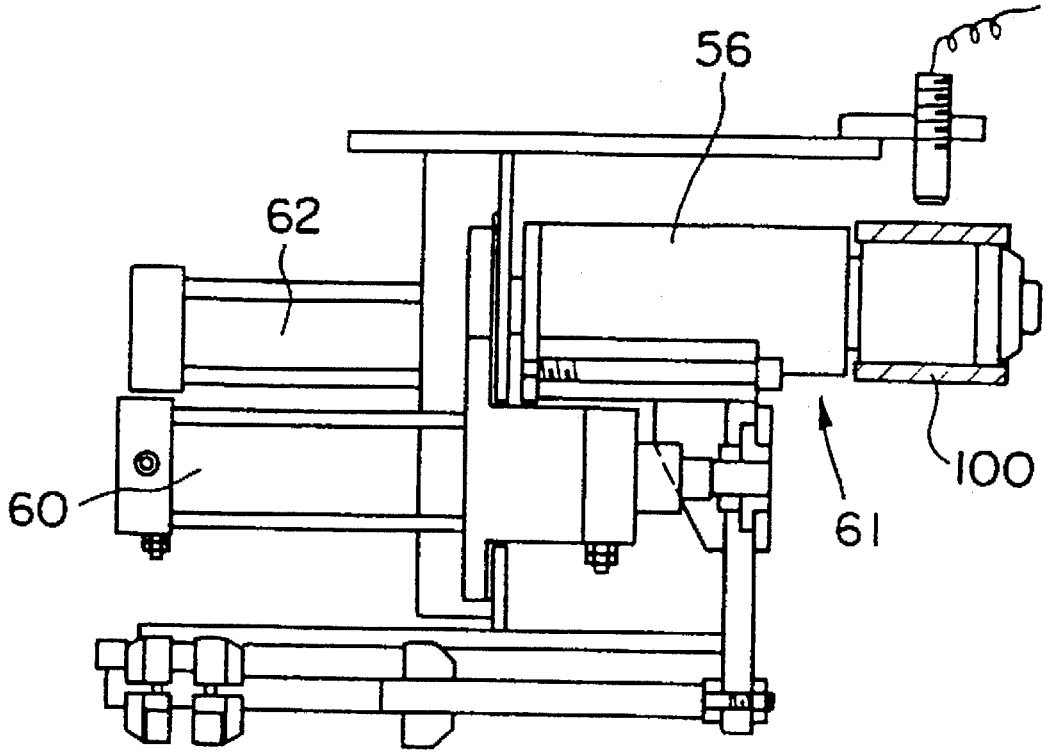
FIG. 6 is a side view showing the construction of an insert head in the prior art.
Figure 7:
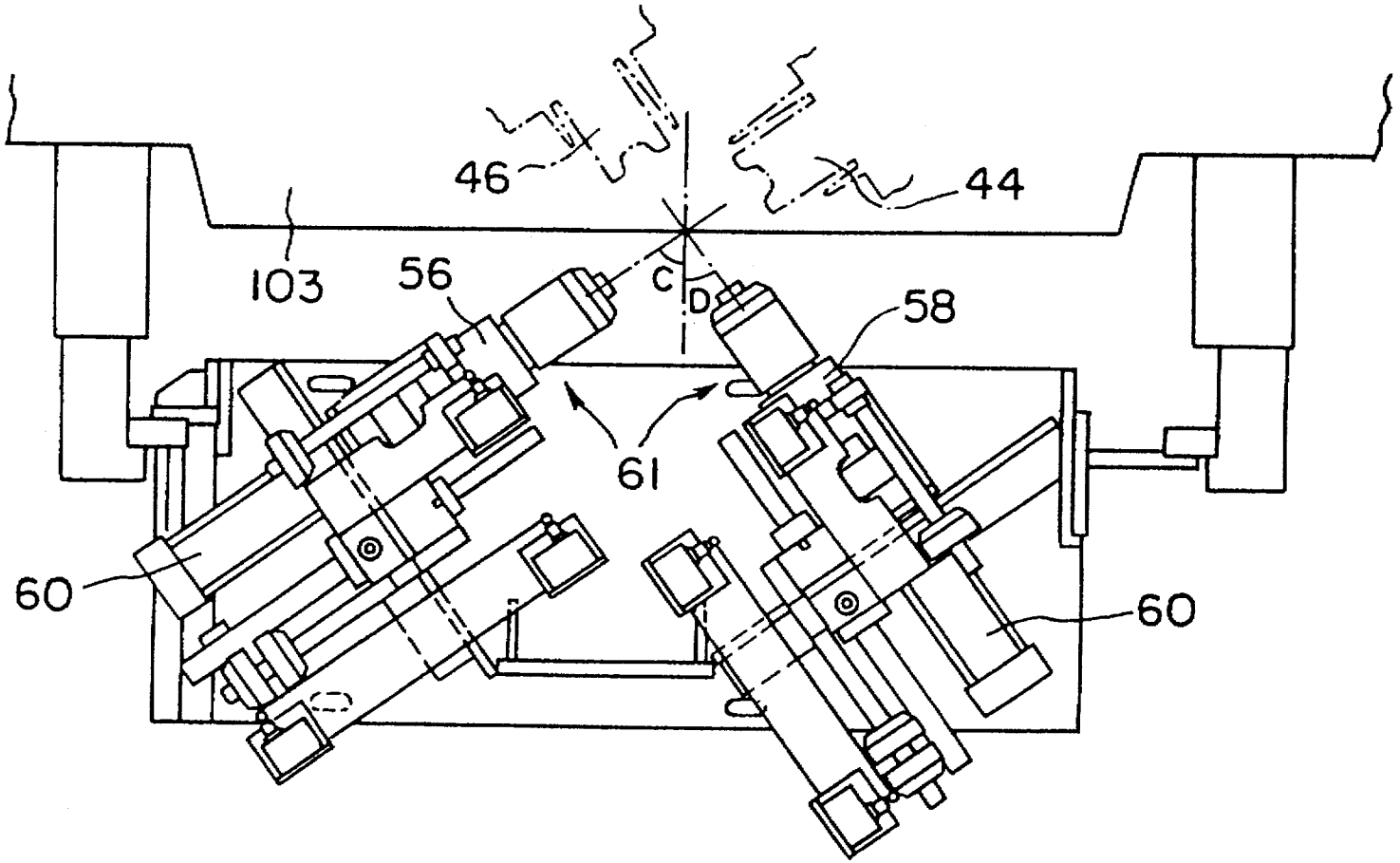
FIG. 7 is a plan view showing an arrangement of the insert head in the prior art in a metal mold in which the directions of inserting the insert members intersect with each other.

FIG. 1 is a front view of the insert member-inserting apparatus 10 according to the embodiment, FIG. 5 is a plan view of the apparatus shown in FIG. 1, and FIG. 3 is a side view of the apparatus shown in FIG. 1 with parts partially broken away. Reference character 16 designates an insert head 16 which comprises insert holders 17 which are loaded with the insert members and a pusher device 18 for pushing out the insert members.

Figure 2:
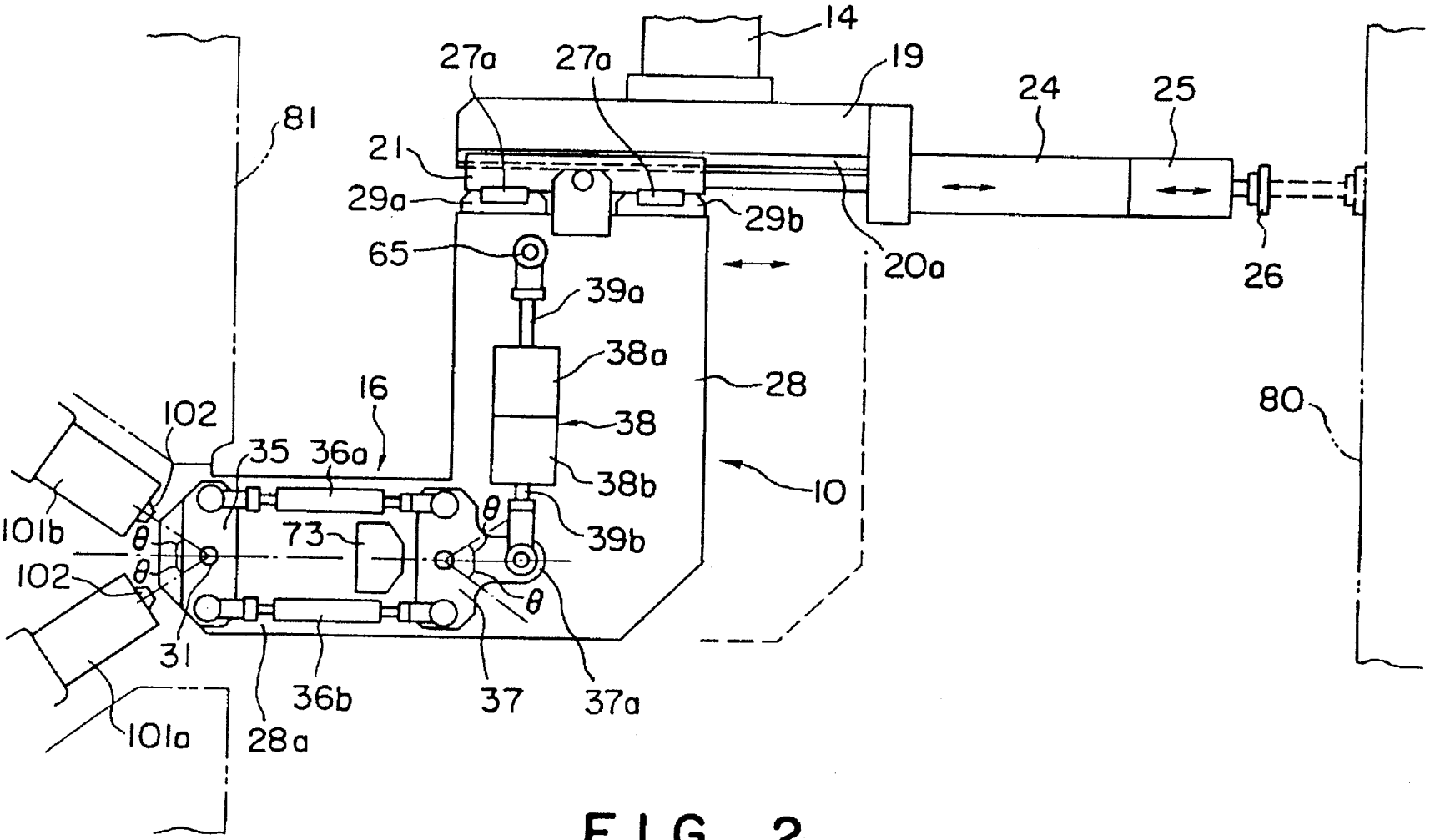
FIG. 2 is a plan view of the apparatus shown in FIG. 1.

In this embodiment, three insert holders 17, 17 and 17 are secured so as to be arranged in a row in the vertical direction to cast the cylinder block of a six-cylinder engine. Each of the insert holders 17 is provided with a floating mechanism to support elastically the insert members in the radial direction, and can be loaded with insert members 100*a* and 100*b* at two stages. Further, each insert holder 17 is formed at the forward end thereof with a recess 17*a*, in which engages a positioning projection 102 extending from both cylindrical cores 101*a* and 101*b* which form parts, onto which the insert members are to be fitted, as shown in FIG. 2. When the positioning projections 102 engage in the recesses 17*a*, the insert members 100*a* and 100*b* come to be adjusted so as to be aligned with the cores 101*a* and 101*b*, respectively. The insert holders 17, 17 and 17 are so mounted that the distance P therebetween corresponds to the distance of arrangement of the cores 101*a* and 101*b*.

A positioning mechanism which pivotably supports the insert head 16 and positions the insert head 16 will be described.

Referring to FIG. 1, the insert member-inserting apparatus 10 is fitted to the forward end of the lift arm 14 through a support base 19. Guide rails 20*a* and 20*a* extending in the direction of opening and closing the molds are secured to the support base 19. A carriage 21 is slidably supported on the guide rails 20*a* and 20*b* through linear bearings 22*a* and 22*b*. As shown in FIG. 5, a transferring piston-cylinder assembly 24 is secured to the support base 19 by way of a bracket 23, and a piston rod 24*a* of the piston-cylinder assembly 24 is connected to the carriage 21 so that the insert head 16 can be moved forward to coincide the center of rotation of the insert head 16 with a point of intersection of the directions of inserting the insert members. In addition, to the head side of the above-mentioned transferring piston-cylinder assembly 24 is connected a piston-cylinder assembly 25 which actuates in the direction of opening and closing the molds and which serves to receive a reaction force produced when the insert member is inserted, and to the positioning piston-cylinder assembly 25 is connected a dash member 26 which comes into an abutting engagement with the stationary mold 80.

Moreover, to the side surface of the carriage 21 are secured a pair of guide rails 27*a* and 27*b* in the direction of intersecting perpendicularly with the guide rails 20*a* and 20*b*, and a pair of portal frames 28 are mounted on the guide rails 27*a* and 27*b* through linear bearings 29*a* and 29*b* at a predetermined distance so that they can be moved a minute fine distance along the guide rails 27*a* and 27*b* by a piston-cylinder assembly (not shown). The portal frame 28 is of an inverted L-shape in a plan view, and has a support 28*a* which is a portion bent at a right angle and extending horizontally. As shown in FIG. 3, a swing frame 30, which comprises a pair of arms 30*a* and 30*b* extending parallel to the direction of inserting the insert members and a connecting wall 30*c* connecting one end of the arm 30*a* and one end of the arm 30*b*, is pivotably supported with pivotal shafts 31 and 31 as a center held on the horizontal supports 28*a* of the pair of portal frames 28. An intermediate carriage 32 having a plate-like mount 32*a*, to which the back ends of the insert holders 17 are fixed, is supported by the swing frame 30 so as to be able to be moved in the direction of opening and closing the molds.

An angularly positioning mechanism 34 will be described which functions to pivotably move the above-mentioned swing frame 30 through a certain angle so that the axes of the insert holders 17 are aligned with the directions of fitting the insert members onto the parts, onto which the insert members are to be fitted, at every row in the movable metal mold. The angularly positioning mechanism 34 includes an arm 35 which is pivotably connected in the center thereof to a pivotal shaft 31. A pair of links 36*a* and 36*b* is connected at the respective one end of each link to two ends of the arm 35 by pins, and are connected at the other ends thereof to a T-shaped crank member 37 by pins so that they constitute a parallel link together with the arm 35 and the T-shaped crank member 37.

The T-shaped crank member 37 is connected at the arm 37*a* thereof to a swing piston-cylinder assembly 38 by a pin.

In this embodiment, the swing piston-cylinder assembly 38 consists of a piston-cylinder assembly which comprises two cylinders connected at their heads so that piston rods 39*a* and 39*b* are directed toward the opposite sides. One of the piston rods 39*b* is pivotably connected to the T-shaped crank member 37 by way of a joint, and the other piston rod 39*a* is pivotably connected to the lateral surface of the portal frame 28 by a pin 65. In this case, when the piston rod 39*a* is moved forward to a limit of forward movement and, simultaneously, the piston rod 39*b* is moved backward to the limit of backward movement, the T-shaped crank member 37 is located in a neutral position, where the insert head 16 is kept in its horizontal position. Reference character 73 in FIG. 5 indicates a stopper for locating the T-shaped crank member 37 at a position where it occupies after pivotal movement through a predetermined angle of θ.

As shown in FIG. 3, to the inside of the swing frame 30 which is pivotably moved through a predetermined angle by said angular positioning mechanism 34 are secured guide rails 66*a* and 66*b* extending longitudinally of the inside surface of the arms 30*a* and 30*b*. An intermediate carriage 32 which constitutes an insert head 16 is guided on the guide rails 66*a* and 66*b*, and is slidably moved forward and backward through linear bearings 67*a* and 67*b* in the axial direction of the insert holders 17 by means of a pair of piston-cylinder assemblies 68*a* and 68*b* secured to the swing frame 30.

In FIG. 3, a pusher device 18 is mounted on the insert head 16 to press out the insert members toward the cores 101*a* and 101*b* which form the parts, onto which the insert members are to be fitted, in the movable metal mold 81.

The pusher device 18 includes press members 69, 69 and 69 which are each incorporated coaxially with the respective insert holder 17 and the front end surfaces of which are in an abutting engagement with the back end surfaces of the insert members 100*a* and 100*b*. The press members 69, 69 and 69 are secured to a bracket 70, which is slidably moved along guide members 71*a* and 71*b* attached to the arms 30*a* and 30*b* of the swing frame 30. A piston rod of a pressing-out piston-cylinder assembly 72 is connected to the bracket 70 by way of a joint.

Alternatively, the guide members 71*a* and 71*b* may be provided on the carriage 32.

The operation of the apparatus of the present embodiment as constructed above will be described.

The conveying device 12 is transferred to an insert member supply station (not shown). In the insert member supply station, two insert members 100*a* and 100*b* are fitted onto each of the insert holders 17, 17 and 17 of the insert head 16 waiting in a horizontal position in two stages in such a way as to be threaded on a skewer, as shown in FIG. 3.

The conveying device 12 is further transferred and the entire insert member-inserting device 10 enters into the space between the stationary metal mold 80 and the movable metal mold 81, which are apart, and is stopped in a predetermined position. In FIG. 2, the piston-cylinder assembly 25 is actuated to bring the press member 26 into an abutting engagement with the stationary metal mold 80. Further, the transfer piston-cylinder assembly 24 is actuated to move the portal frame 28 toward the movable frame 81 from a position shown with the broken line to a position shown with the full line. In this way, the insert head 16 is positioned between the stationary metal mold 80 and the movable metal mold 81. The operation performed in this position comprising the steps of pivotably moving the swing frame 30 to angularly position the insert holders 17 and mounting the insert members 100*a* and 100*b* onto the insert member-inserting part of the movable metal mold 81 will be described below.

First, the operation of fitting the insert member 100*a* onto the core 101*a* arranged in one of the right and left rows of the cores 101*a* and 101*b* will be described.

The first piston-cylinder assembly 38*a* of the swing piston-cylinder assembly 38 is actuated to move the piston rod 39a backward to the limit position of backward movement, thereby pivotably moving the T-shaped crank member 37 counterclockwise with a supporting point as a center. Thus, the swing arm 35 is pivotably moved counterclockwise by an angle of θ and, so, the entire swing frame 30 holding the insert head 16 is pivotably moved counterclockwise by an angle of θ, whereby angular positioning is performed so that the direction of inserting the insert members and the axes of the insert holders 17 are aligned.

In FIG. 3, the piston-cylinder assemblies 68*a* and 68*b* are actuated to move the intermediate carriage 32 forward. Along with the forward movement of the intermediate carriage 32, each of the insert holders 17 is moved toward the parts, onto which the insert members are to be fitted, within the movable metal mold 81 until the forward end of each insert holder comes into an abutting engagement with the end surface of each of the cores 101*a*. At that time, the positioning projections 102 on the end surfaces of the cores 101*a* and the recesses 17*a* on the front end surfaces of the insert holders 17 engage with each other so that the insert members 100*a* are aligned with the cores 101*a*.

When the pressing-out piston-cylinder assembly 72 is actuated in the aligned position, the press members 69, 69 and 69 are moved forward to press out the insert members 100*a* from the insert holders 17 and fit them onto the outer surfaces of the cores 101*a* so as to put them on, thereby allowing the insert members 100*a* to be mounted on the arrangement of the cores 101*a* with one motion.

When the insert members 100*b* are subsequently mounted on the arrangement of the cores 101*b*, in FIG. 2, the second piston rod 39*b* of the swing piston-cylinder assembly 38*b* is extended to a limit of forward motion to pivotably move the T-shaped crank member 37 clockwise by an angle of θ. This also pivotably moves the swing arm 35 in the same direction by the same angle and, so, the insert holders 17, 17 and 17 are positioned so that the axes thereof become parallel to the axes of the cores 101*b*. In this embodiment, since the arrangement of the cores 101*b* alternates with that of the cores 101*a*, a piston-cylinder assembly (not shown) is actuated to vertically move the entire portal frame 28 by a distance of half the distance P between the adjacent insert holders 17 so that the insert holders 17 are aligned with the arrangement of the cores 101*b*.

Then, in FIG. 3, the piston-cylinder assemblies 68*a* and 68*b* are actuated to move forward the intermediate carriage 32 in a way similar to the above-mentioned way. The forward movement of the intermediate carriage 32 causes the recesses on the front end surfaces of the insert holders 17 to engage the projections of the cores 101*b*, so that the cores 101*b* and the insert members 100*b* mounted on the insert holders 17 are aligned.

When the pressing-out piston-cylinder assembly 72 is actuated for insertion of the insert members 100*b*, the press members 69 press out the remaining insert members 100*b* and fit them onto the outer surfaces of the cores 101*b* so as to put them on. This allows the plurality of insert members 100*b* to be mounted simultaneously with one motion. When mounting the insert members 100*a* and 100*b* is completed as described above, the first piston rod 39*a* of the swing piston-cylinder assembly 38 is extended to a limit of forward motion and, simultaneously, the second piston rod 39*b* is moved backward, thereby restoring the swing frame 28 to its horizontal position.

Thereafter, the piston rod of the transfer piston-cylinder assembly 24 is moved backward to transfer the portal frame 28 so that the entire insert head 16 is moved away from the movable metal mold 81. Further, the positioning piston-cylinder assembly 25 is actuated to move the dash member 26 away from the stationary metal mold 80; thereafter, the lift arm 14 of the conveying device 12 is lifted and the insert member-inserting device 10 is carried to the insert member supply station (not shown). In this way, the operation of one cycle is finished. Thereafter, the next cycle of casting follows.

As is apparent from the above-mentioned description, since the present invention comprises arranging the insert holders each loaded with the insert members in multiple stages, in a row; positioning the insert head; and thereafter, performing an angular positioning operation which aligns the insert holders with the parts, onto which the insert members are to be fitted, at every row within the metal mold, a reduction in the number of the insert holders can be realized, thereby allowing a reduction in weight and a saving in space to be achieved to a great degree, as compared with the apparatus in the prior art in which a great number of insert holders are provided for the parts, onto which the insert members are to be fitted, at every row.

What is claimed is:

1. An apparatus for inserting one or more insert members having an insert head comprising:

insert holders for holding sleeve-like insert members;

a mechanism for holding said insert holders for transferring movement in the direction of inserting said insert members and for pivotable movement about a shaft intersecting perpendicular to the direction of said transferring movement; and a mechanism for pressing out said insert members from said insert holders in the direction of inserting said insert members; and a positioning mechanism which supports said insert head for transferring movement in at least the two and more axial directions intersecting perpendicularly to each other and which positions said insert head between said metal molds which are apart, wherein said insert head comprises:

a first support member connected to said positioning mechanism;

a second support member pivotably mounted on said first support member;

a third support member which is mounted on said second support member for sliding movement in the direction of inserting said insert members and which holds said insert holders;

a fourth support member which is mounted on said second support member for sliding movement in the direction of inserting said insert members and which partially engages said insert members held on said insert holders;

a swinging mechanism secured to said first support member and for driving said second support member in pivotable movement;

a sliding means secured to said second support member and for sliding said third member; and a drive means secured to said second support member and for driving said fourth support member.

2. An apparatus for inserting one or more insert members having an insert head comprising:

insert holders for holding sleeve-like insert members;

a mechanism for holding said insert holders for transferring movement in the direction of inserting said insert members and for pivotable movement about a shaft intersecting perpendicular to the direction of said transferring movement; and a mechanism for pressing out said insert members from said insert holders in the direction of inserting said insert members; and a positioning mechanism which supports said insert head for transferring movement in at least the two and more axial directions intersecting perpendicularly to each other and which positions said insert head between said metal molds which are apart, wherein each of said insert holders are of such a length that it can be loaded with a plurality of said insert members in the direction of inserting said insert members.

3. An apparatus for inserting one or more insert members having an insert head comprising:

insert holders for holding sleeve-like insert members;

a mechanism for holding said insert holders for transferring movement in the direction of inserting said insert members and for pivotable movement about a shaft intersecting perpendicular to the direction of said transferring movement; and a mechanism for pressing out said insert members from said insert holders in the direction of inserting said insert members; and a positioning mechanism which supports said insert head for transferring movement in at least the two and more axial directions intersecting perpendicularly to each other and which positions said insert head between said metal molds which are apart, wherein a plurality of said insert holders are parallel arranged in the direction of intersecting perpendicular to the direction of inserting said insert members.

4. An apparatus for inserting one or more insert members as claimed in claim 1, wherein said positioning mechanism comprises a support base which supports said first support member for sliding movement in the horizontal direction; a lift means for moving said support base vertically; and a drive means secured to said support base and for sliding said first support member.

5. An apparatus for inserting one or more insert members as claimed in claim 4, wherein said first support member includes a carriage slidably mounted on said support base; and a pair of frames secured to said carriage at a predetermined distance and having a support part extending horizontally.

6. An apparatus for inserting one or more insert members as claimed in claim 1, wherein said second support member is pivotably mounted on said first support member by pivotal shafts.

7. An apparatus for inserting one or more insert members as claimed in claim 6, wherein said second support member comprises a pair of arms extending parallel to the direction of inserting said insert members and a connecting wall which connects the respective one ends of said pair of arms, the other ends of said pair of arms being each fitted onto said pivotal shafts.

8. An apparatus for inserting one or more insert members as claimed in claim 7, wherein said third support member includes a plate-like mount to which the back ends of said insert holders are fixed, said plate-like mount being slidably held at both ends thereof on said pair of arms of said second support member.

9. An apparatus for inserting one or more insert members as claimed in claim 7, wherein said fourth support member comprises press members which are arranged at the back of said insert holders and which come into an abutting engagement with the back ends of said insert members held on the insert holders, and a bracket to which said press members are fixed, said bracket being slidably held at both ends thereof on said pair of arms of said second support member.

10. An apparatus for inserting one or more insert members as claimed in claim 6, wherein said swinging mechanism comprises a link mechanism for converting a linear movement into a rotating movement and a linear piston-cylinder assembly connected to one end of said link mechanism, said link mechanism being connected at the other end thereof to said pivotal shafts which pivotably hold said second support member.

11. An apparatus for inserting one or more insert members as claimed in claim 4, wherein a stopper means for stopping the movement of said support base in the direction opposite the direction of inserting said insert members are secured to said support base of said positioning mechanism.

12. An apparatus for inserting one or more insert members as claimed in claim 11, wherein said stopper means includes a positioning piston-cylinder assembly and a dash member attached to the piston rod of said positioning piston-cylinder assembly.

* * * * *